United States Patent [19]

Schober

[11] 4,015,461

[45] Apr. 5, 1977

[54] CLOSED DROP FORGING DIE

[75] Inventor: Franz Schober, Munich-Obermenzing, Germany

[73] Assignee: Bayerische Leichtmetallwerk Graf Bluecher von Wahlstatt KG, Munich, Germany

[22] Filed: Nov. 20, 1975

[21] Appl. No.: 633,822

Related U.S. Application Data

[63] Continuation of Ser. No. 483,631, June 27, 1974, which is a continuation-in-part of Ser. No. 301,873, Oct. 30, 1972.

[30] Foreign Application Priority Data

July 27, 1972 France ..... 72.27067

[52] U.S. Cl. ..... 72/358; 72/360; 72/470; 29/159.2

[51] Int. Cl.[2] ..... B21J 1/06; B21J 5/00

[58] Field of Search ..... 72/352, 357, 358, 359, 72/360, 470; 29/159.2; 10/86 F

[56] References Cited

UNITED STATES PATENTS

| | | | |
|---|---|---|---|
| 2,756,876 | 7/1956 | Watson et al. | 72/353 X |
| 2,953,247 | 9/1960 | Walter et al. | 72/267 X |
| 2,964,838 | 12/1960 | Schober | 29/159.2 |
| 2,966,987 | 1/1961 | Kaul | 72/359 |

FOREIGN PATENTS OR APPLICATIONS

| | | | |
|---|---|---|---|
| 755,107 | 3/1953 | Germany | 72/267 |
| 1,025,298 | 4/1966 | United Kingdom | 29/159.2 |

*Primary Examiner*—Carl E. Hall
*Assistant Examiner*—D. M. Gurley
*Attorney, Agent, or Firm*—W. G. Fasse; W. W. Roberts

[57] ABSTRACT

The present drop-forging die includes an upper and a lower die member which are pressed together in the forging operation to form a closed cavity of the shape of the finished workpiece without a flash gutter at the interface of the die members. The die is constructed in a manner to force the heated material of the blank to follow a predetermined flow pattern whereby to completely fill the different spaces within the die cavity in a fixed sequence before the material is cooled off enough to cause fabrication defects. More specifically, the material is forced to first flow downwardly to fill a recess in the bottom of the lower die member. Thereafter the cavity elements of the upper die member are filled by a material flow in the opposite direction. For this purpose the blank rests on a narrow annular surface around its bottom edge portion and is mostly unsupported in its center portion above said recess.

4 Claims, 5 Drawing Figures

CLOSED DROP FORGING DIE

BACKGROUND OF THE INVENTION

The present invention relates to improvements in closed drop-forging dies and this application is a continuation application of my copending application 483,631 filed June 27, 1974, which in turn was a continuation-in-part application of Ser. No. 301,873 filed Oct. 30, 1972.

In a known drop-forging method employing a closed die as described in Czechoslovakian Pat. No. 121,430, the remolding process takes place in four operational steps, namely as free compressing, intermediate forming, final forming and punching or perforating. The intermediate forming prepares for the final forming, whereby the forging is performed in a half-open die in such a manner that the final shape of the workpiece is almost or substantially achieved. However, the workpiece receives the desired precise shape only in the final forming step.

Closed drop-forging dies of this type generally comprise a first or upper die member and a second or lower die member which are pressed against each other in the forging process. It has been observed that in the forging operation in a closed die having a surface portion extending at right angles to the main remolding direction, deflects are more frequently caused on the surface of the forged workpiece in the first die member, that is to say, the die member which comes first as viewed in the compression direction. Such defects occur often because the material flows first to fill the first die member only partially, whereupon the second die member is completely filled and thereafter the first die member is filled completely. Thus, the complete filling of the first die member often takes place at a moment when the material, which has partially filled the first die member, has cooled off somewhat after it has partially filled the second die member thereby making the final molding difficult.

My previous U.S. Pat. No. 2,964,838 also described a closed drop-forging die, especially for manufacturing bevel gear wheels. The die cavity forming elements of my previous patent are provided with a recess or so called flash gutter at the interface between the upper and lower die forming members. The flash gutter is provided for the purpose of taking up excess material which requires an additional machining step of the finished workpiece because a burr or flash is formed all around the finished workpiece, as best seen in FIG. 4 of my previous U.S. Pat. No. 2,964,838. It would be desirable to avoid the formation of such burrs which heretofore has caused substantial problems in connection with so called completely closed drop-forging dies.

U.S. Pat. No. 2,756,876, R. E. Watson et al, discloses a punching die assembly which includes a cavity in a lower die member and a male punch which fits with sufficient play into the cavity so as to leave space between the punch and the wall of the cavity for the material flow. This type of tool does not pose the problem of closed forging dies, because there is always sufficient space provided for the escape of the material. In other words, the volume of the blank is always substantially smaller than the volume of the cavity which is formed even in the final position of the tool elements relative to each other.

OBJECTS OF THE INVENTION

In view of the above, it is the aim of the invention to achieve the following objects, singly or in combination:

- to provide a so called closed drop-forging die which will not require a flash gutter or recess at the interface of the die members so as to avoid the formation of burrs at the interface between the two die members;
- to avoid the partial filling of die cavity elements, in other words, to assure that the material flow does not have to be reversed more than once;
- to force the material flow in such a manner that first one cavity element is completely filled as the result of material flow in one direction and that thereafter the other cavity elements are completely filled as a result of a material flow in the opposite direction;
- to assure that all the required material flow is completed before cooling of the material would cause defects in the finished product;
- to adapt the volume of the blank to correspond substantially to the volume of the closed die cavity to avoid the need for a flash gutter or to permit the location of an excess space remote from the interface of the two die members so as to eliminate or at least substantially minimize subsequent machining of the workpiece;
- to keep the cooling of the blank being forged to a minimum during the forging and the control the material flow by the shape of the die cavity in such a manner that the required forging force and energy are minimized; and
- to control the material flow in a closed drop-forging die without a flash gutter at the interface between the drop-forging die members in such a manner that a predetermined flow pattern will cause the filling of the die cavity elements in a predetermined sequence and prior to cooling of the material to a point which would tend to cause defects in the finished product.

SUMMARY OF THE INVENTION

According to the invention there is provided a closed drop-forging die comprising an upper or first die member with a pressure applying surface flanked or surrounded by respective cavity elements and a second die member with a blank supporting surface facing said pressure applying surface whereby the blank supporting surface is substantially smaller than the pressure applying surface so that the material of the blank flows first in the compression direction and then in a direction substantially opposite to the compression direction to first completely fill a cavity element in the second or lower die member and then to fill the remaining cavity elements. Due to this correlation of the internal elements of the closed drop-forging die the degree of remolding or deformation of the blank in the compression direction is smaller than in the opposite direction which has the advantage that the required time for the entire forging is reduced and hence the cooling is also reduced because the final shape of the workpiece, the dimension of the blank, and the shape and volume of the cavity are correlated to each other with due regard to causing a most efficient material flow.

The present invention will best be realized by means of an embossed mold or die in which the difference between the areas of the surface supporting the blank in the compression direction, and that in the opposite direction and/or the difference between the degree of remolding in those directions assumes a maximum value.

The material flow according to the invention is controlled by the above correlation of features to cause first a flow in the direction of pressure application until the respective cavity element in the mold or die is completely filled, and then to cause a second material flow in the opposite direction also until the respective cavity element or elements of the mold is/are precisely filled.

It is an advantage of the invention that the workpieces obtained a single working stroke in a drop-forging die or process do not require any subsequent reworking or substantial machining since a flash gutter at the interface of the two die members is avoided. The surface of the workpiece is free of defects, also in regard to the surface portions formed in the first or upper drop-forging die member and adjacent to the interface between the die members.

It is possible to keep the cooling of the workpiece during the drop-forging within small limits because the material flow is forced to first fill the embossed cavity of the lower mold or die member and then in the second portion of material flow, to fill the embossed cavity of the upper mold or die member. Since the mold shape as taught herein causes the material flow first in the compression direction and due to the fact that the forming in that direction is smaller than in the opposite direction, an especially fast filling of the embossed cavity of the second or lower die member is achieved, so that in practice the material entering afterwards into the embossed cavity of the first or upper die member is hardly cooler than at the beginning and therefore still moldable or deformable in a very efficient manner. In practicing the present invention, the average temperature during the forging operation is kept higher than that of the prior art, hence small forging forces and less energy are sufficient.

BRIEF FIGURE DESCRIPTION

In order that the invention may be clearly understood, it will now be described, by way of example, with reference to the accompanying drawings, wherein.

DETAILED DESCRIPTION OF AN EXAMPLE EMBODIMENT

Figure 1:
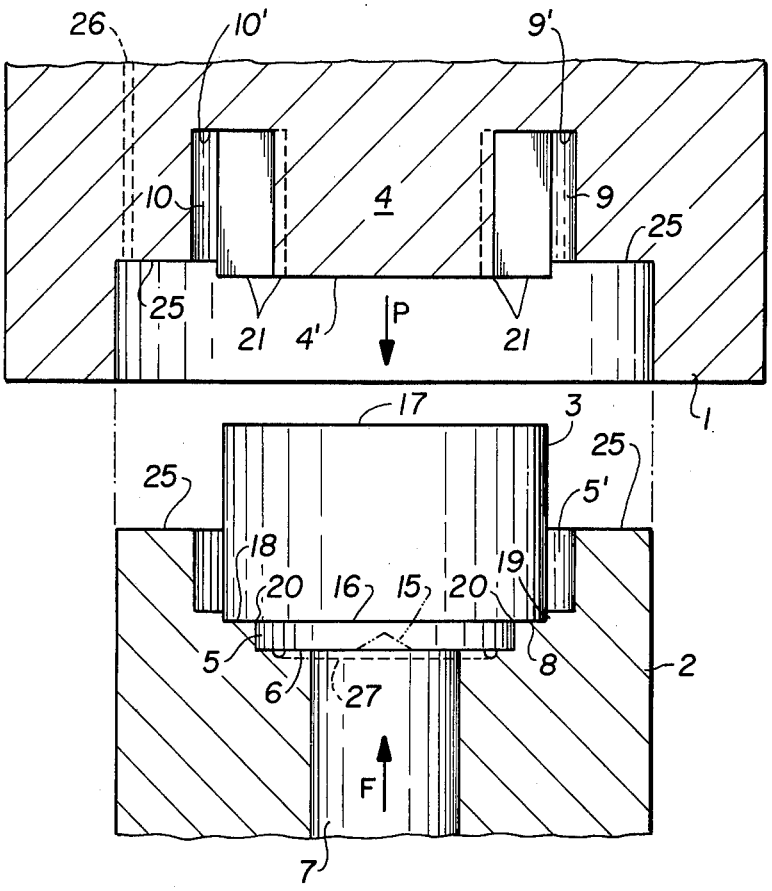
FIG. 1 is a longitudinal sectional view through the upper and lower die members in their open position whereby a blank rests on the lower die member.
Figure 2:
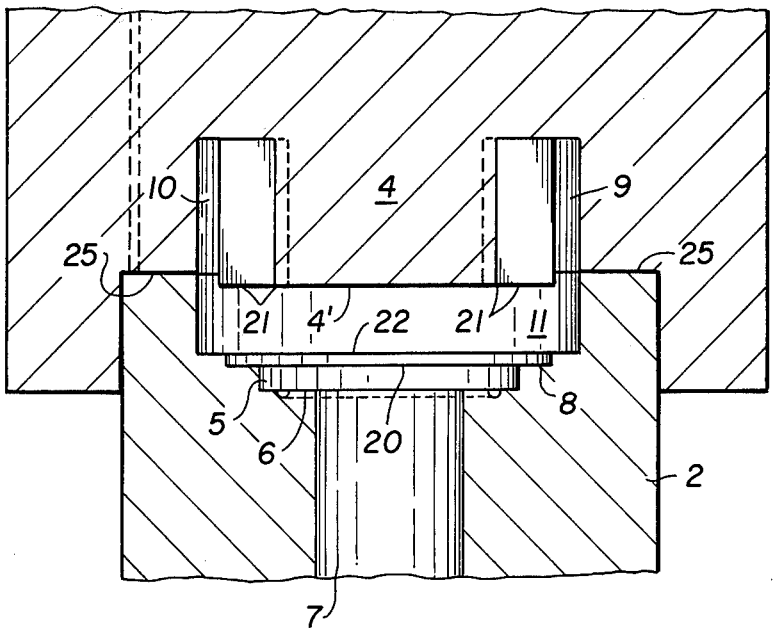
FIG. 2 is a sectional view similar to that of FIG. 1 but showing the two die members in the closed position with the workpiece removed from the die.

Referring to FIG. 1, a first or upper die member 1 is arranged in longitudinal axial alignment for cooperation with a second or lower die member 2. In the closed position of the die members 1 and 2, as shown in FIG. 2, they enclose a die cavity 11. The cavity 11 comprises several cavity elements in the upper and lower die members as will be described in more detail below. A cylindrical blank 3, having a flat bottom surface 16 and a flat top surface 17 is resting with its annular lower edge portion 18 on a ring surface 8 formed in the lower die member 2.

Figure 3:
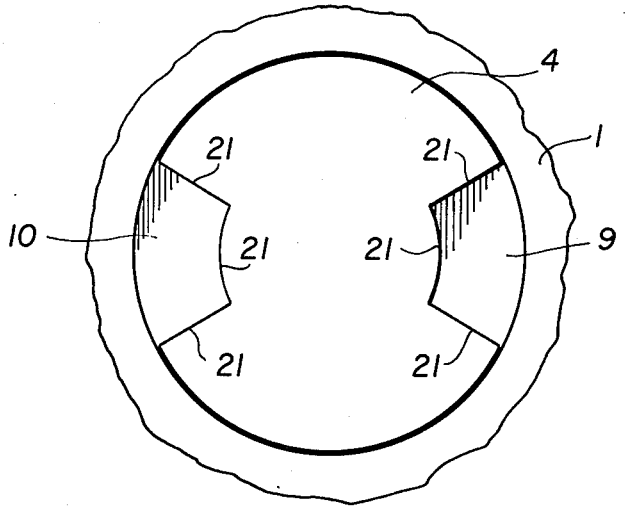
FIG. 3 is a view against the direction of arrow P in FIG. 1 to illustrate the pressing surface of the upper die member.

The upper die member 1 comprises a central core 4 having a somewhat butterfly shaped cross-sectional form resulting from a substantially cylindrical central portion flanked on opposite sides by ring segments, as best seen in FIG. 3. This somewhat butterfly shaped core 4 of the upper die member 1 provides a pressure applying surface 4′ also having the same shape and facing in the direction of the arrow P in FIG. 1.

As mentioned, the cavity 11 comprises several cavity elements. Two such cavity elements 9 and 10 are located in the upper die member 1 to the right and left of the central core 4. The lower or second die member 2 is so shaped that a cavity element 5, for example, in the form of a relatively flat cylindrical recess 5 is located below the blank supporting ring surface 8 in the lower die member 2. A further cylindrical cavity element is confined by the lower die member above the ring surface 8. Only the ring portion 5′ of the cavity element in the lower die member 2 is shown in FIG. 1, because the central portion is taken up by the blank 3.

In order to precisely center the blank 3 in the lower die member 2, there is provided a further cavity element in the lower die member intermediate the recess 5 and the ring cavity element 5′. This further cavity element is formed by a cylindrical axially extending wall 19 surrounding the supporting surface 8, whereby in addition to the step 20 formed by the recess 5 and the surface 8, a further step 22 is formed by the cylindrical wall 19 and the bottom of the ring element 5′. The cylindrical wall 19 properly centers the blank 3.

The lower die member 2 is closed by an ejector 7 axially movable in the direction of the arrow F. Centrally on top of the ejector 7 there may be provided a thorn 15 for centering the finished workpiece 14, if desired.

The blank 3 after having been heated to a temperature suitable for the drop-forging or molding step, for instance 1,000° C is placed on the supporting ring surface 8, whereupon the upper die member 1 is lowered in the direction of the arrow P to apply pressure to the top surface 17 of the blank 3 in a pattern corresponding to the pressure applying surface 4′ of the upper die core 4. According to the invention the surface area of the surface 4′ is substantially larger than the surface area of the ring supporting surface 8. The area of the surface 8 preferably corresponds up to about 20% of the surface area of the surface 4′. This feature assures that the material of the blank 3 is first forced to flow downwardly around the edge 20 to first completely fill the recess 5. After the recess or cavity element 5 has been completely filled, the material of the blank will be forced to flow in the direction opposite to that of pressure application, namely upwardly around the edges 21 of the pressure applying surface 4′, whereby the cavity elements 9 and 10 are filled by the upward flow of the material. Simultaneously, with or with a slight time delay a radially outwardly directed extension of the material is accomplished around the edge 22 to completely fill the cavity 11 when the upper and lower die members 1 and 2 contact each other at the interface 25.

Figure 4:
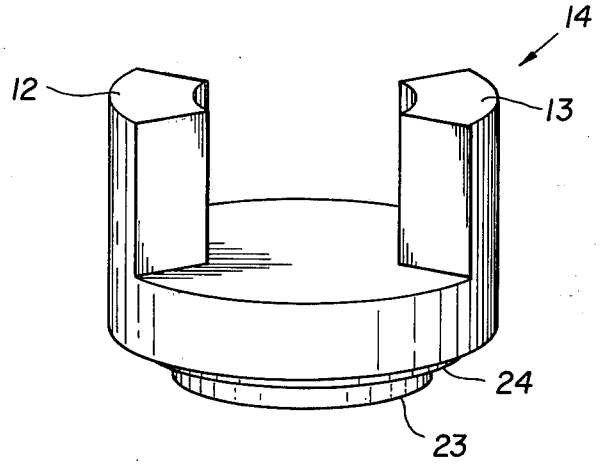
FIG. 4 is a perspective view of the finished workpiece produced according to the invention in a form of a claw coupling or clutch member.

The volume of the cavity 11 corresponds substantially to the volume of the blank 17 and thus to the volume of the finished workpiece 14 shown in FIG. 4. To this end the die is provided with venting means 26 which are schematically shown for example in the upper die member. It should be noted here, however, that the venting means could be placed in any convenient location best suitable for the purpose. Thus, the venting means could also be located in the lower die member. In any event, the dies according to the invention obviate the need for a so called flash a gutter or recess, whereby the interface surfaces 25 contact each other along their entire surface area, whereby burrs or a flash in the finished workpiece 14 at the location of the interface between the two die members are avoided. If desired, a relatively small excess space could be provided in the die remote from the interface 25. Such a space is shown in the form of a groove 27 located in the lower die member 2.

Figure 5:
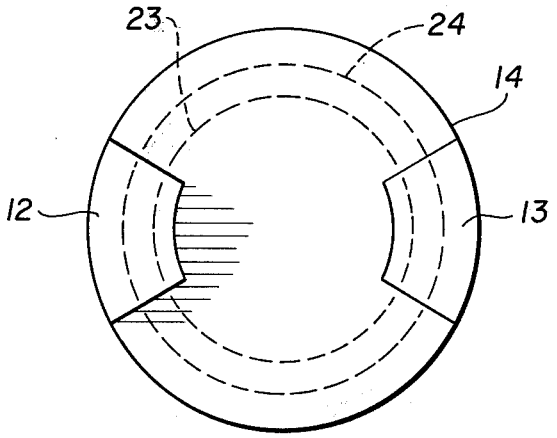
FIG. 5 is a plan view of the finished workpiece.

Referring to FIGS. 4 and 5 illustrating the workpiece 14 it will be noted that the claw members 12 and 13 are formed in the cavity elements 9 and 10 of the upper die member. An outer ring end 23 of the finished workpiece 14 is formed in the recess 5. An intermediate or inner ring end 24 is formed by the surface 8 and the cylindrical wall 19. It is considered to be a substantial advance in the art that such a workpiece having a relatively complicated shape may be formed in one drop forging stroke by employing the present teachings, whereby subsequent machining steps are eliminated or at least substantially reduced by avoiding a flash gutter at the interface of the die members.

As mentioned above, due to the correlation of the internal shape features of the present die, especially making the seating surface area of the surface 8 substantially smaller than the surface area of the pressure applying surface 4', it is assured that the material is forced to start very quickly to flow around the internal edge 20 to completely fill the recess 5 prior to any flow in the opposite direction around the edges 21 of the surface 4'. The pressure ratios are changed as soon as the recess 5 is filled because then the entire surface of the bottom 6 with the top surface of the ejector 7 becomes effective to cause the flow in the direction opposite to the direction of pressure application indicated by the arrow P. In this context it will be noted that the bottom 6 of the lower die member is located remote from the seating surface 8 and similarly the bottoms 9' and 10' are also located remote or axially away from the pressure applying surface 4' in the upper die member. This correlation of features cannot be compared with the arrangement of elements, for example, in U.S. Pat. No. 2,756,876 where the entering male punch causes a material flow which is first directed radially outwardly and not downwardly in the direction of the movement of the male punch.

Although the invention has been described with reference to specific example embodiments, it will be appreciated that it is intended to cover all modifications and equivalents within the scope of the appended claims.

What is claimed is:

1. A closed hot drop-forging die for shaping a blank into a claw coupling member, including a first upper die member (1) having first cavity elements (9, 10) including respective first cavity bottoms (9', 10') and a second lower die member (2) having second cavity elements (5, 5'), including a second cavity bottom (6), said first and second cavity elements (5, 5') forming a closed die cavity (11) when the die members are in interface contact with each other, the volume of the die cavity in the closed condition of the die members corresponding to the volume of said blank, the die members having interface surfaces which completely contact each other in the closed condition of said die members to avoid a flash gutter at said interface surfaces, and wherein one of the die members is movable relative to the other along a central, longitudinal axis common to both die members, wherein the first upper die member (1) comprises a first facing surface (4') having a central portion and sectional portions extending radially outwardly from said central portion, said first facing surface being located symmetrically and centrally relative to said longitudinal axis and adapted to initially engage one facing surface (17) of the blank to apply the forging pressure to the blank, said first facing surface (4') being located axially and radially remote from the first cavity bottoms (9', 10') of the first cavity elements (9, 10), said first facing surface (4') having a given surface area, and wherein the second, lower die member (2) comprises a second, substantially ring shaped facing surface (8) constituting a counter support adapted to initially support a corresponding ring surface (18) of the blank opposite said one facing surface (17) of the blank, said second facing surface (8) being located axially remote from the second bottom (6) of the second cavity elements (5') of the second lower die member (2), wherein the second cavity elements include a recess (5) below said ring shaped facing surface (8) and an annular cavity element (5') above said ring shaped surface (8), and a cylindrical wall portion (19) between said surface (8) and said second cavity element (5') to center the blank and close the lower cavity when the blank rests on said surface (8), said second ring shaped facing surface (8) having a surface area substantially less than said given surface area of said first facing surface (4') which applies the forging pressure to the blank, whereby upon relative movement between the two die members (1, 2) the material of the blank is forced to first flow axially into said recess (5) below said ring shaped facing surface (8) of the second die member (2) to fill this recess (5) completely prior to being forced to flow axially in the opposite direction to then enter the cavity elements (9, 10) of the first upper die member (1) whereafter the cavity (11) of the first and second die members is completely filled, said die further comprising venting means.

2. The closed hot drop-forging die according to claim 1, wherein the surface area of said second facing surface (8) corresponds to about 20% of the surface area of the first facing surface (4').

3. The closed hot drop-forging die according to claim 1, wherein said sectional portions extending radially outwardly from said circular inner portion comprises ring segments flanking said circular portion and arranged opposite each other to provide cut-outs between the ring segments.

4. The closed hot drop-forging die according to claim 1, wherein a relatively small excess space gutter is provided in the die cavity remote from said interface surfaces.

* * * * *